US011688411B2

(12) United States Patent
Morton et al.

(10) Patent No.: US 11,688,411 B2
(45) Date of Patent: Jun. 27, 2023

(54) AUDIO SYSTEMS AND METHODS FOR VOICE ACTIVITY DETECTION

(71) Applicant: Bose Corporation, Framingham, MA (US)

(72) Inventors: Douglas George Morton, Southborough, MA (US); Pepin Torres, Waltham, MA (US); Xiang-Ern Sherwin Yeo, Cincinnati, OH (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 17/972,188

(22) Filed: Oct. 24, 2022

(65) Prior Publication Data

US 2023/0040975 A1 Feb. 9, 2023

Related U.S. Application Data

(63) Continuation of application No. 16/995,134, filed on Aug. 17, 2020, now Pat. No. 11,482,236.

(51) Int. Cl.
*G10L 21/0232* (2013.01)
*G10L 21/0216* (2013.01)

(52) U.S. Cl.
CPC ..... *G10L 21/0232* (2013.01); *G10L 2021/02166* (2013.01)

(58) Field of Classification Search
CPC ..... G10L 21/0232; G10L 2021/02166; G10L 15/20; G10L 21/0205; G10L 21/038; G10L 21/0272
See application file for complete search history.

(56) References Cited

U.S. PATENT DOCUMENTS

| | | | | |
|---|---|---|---|---|
| 9,843,861 | B1 * | 12/2017 | Termeulen | H04R 1/1016 |
| 10,096,328 | B1 * | 10/2018 | Markovich-Golan | G10L 21/0216 |
| 2011/0231185 | A1 * | 9/2011 | Kleffner | G10L 21/0272 704/226 |
| 2018/0012616 | A1 * | 1/2018 | Salishev | H04R 1/04 |
| 2018/0102135 | A1 * | 4/2018 | Ebenezer | G10L 25/84 |
| 2018/0102136 | A1 * | 4/2018 | Ebenezer | G10L 15/16 |
| 2018/0192191 | A1 * | 7/2018 | TerMeulen | H04R 1/406 |
| 2018/0270565 | A1 * | 9/2018 | Ganeshkumar | G10L 25/84 |
| 2019/0098399 | A1 * | 3/2019 | Lashkari | H04R 1/406 |
| 2019/0251955 | A1 * | 8/2019 | Degraye | H04R 3/005 |
| 2019/0385635 | A1 * | 12/2019 | Shahen Tov | G10L 25/21 |
| 2020/0213726 | A1 * | 7/2020 | Dyrholm | H04R 3/005 |

(Continued)

*Primary Examiner* — Mohammad K Islam
(74) *Attorney, Agent, or Firm* — Bose Corporation

(57) ABSTRACT

Audio systems, methods, and processor instructions are provided that detect voice activity of a user and provide an output voice signal. The systems, methods, and instructions receive a plurality of microphone signals and combine the plurality of microphone signals according to a first combination and a second combination. The first combination produces a primary signal having enhanced response in the direction of the user's mouth, and the second combination produces a reference signal having reduced response in the direction of the user's mouth. The primary signal and the reference signal are added and subtracted to produce a voice-enhanced signal and a voice-reduced signal, respectively. The voice-enhanced signal and the voice-reduced signal are compares and an output voice signal is provided based upon the comparison.

20 Claims, 6 Drawing Sheets

(56) References Cited

U.S. PATENT DOCUMENTS

| | | | | |
|---|---|---|---|---|
| 2020/0302922 | A1* | 9/2020 | Jazi | G10L 25/84 |
| 2021/0043223 | A1* | 2/2021 | Lee | G06F 3/0346 |
| 2021/0306751 | A1* | 9/2021 | Roach | H04R 1/1041 |

* cited by examiner

AUDIO SYSTEMS AND METHODS FOR VOICE ACTIVITY DETECTION

CROSS REFERENCE TO RELATED APPLICATIONS

This application claims the benefit under 35 USC § 120 to U.S. patent application Ser. No. 16/995,134, filed on Aug. 17, 2022, titled AUDIO SYSTEMS AND METHODS FOR VOICE ACTIVITY DETECTION, the content of which is incorporated herein in its entirety for all purposes.

BACKGROUND

Various audio devices such as headphones, earphones, and the like are used in numerous environments for various purposes, examples of which include entertainment purposes such as gaming or listening to music, productive purposes such as phone calls, and professional purposes such as aviation communications or sound studio monitoring, to name a few. Different environments and purposes may have different requirements for fidelity, noise isolation, noise reduction, voice pick-up, and the like. Various echo and noise cancellation and reduction systems and methods, and other processing systems and methods, may be included to improve accurate communication in providing a user's speech or voice output signal.

Some such systems and methods exhibit increased performance when the system or method has a reliable indication that a user of the device is actively speaking. For example, certain systems and methods may change various processing, such as filter coefficients, adaptation rates, reference signal selection, and the like, upon a reliable determination that the user is speaking. The enhanced performance of these systems and methods may allow the user's voice to be more clearly separated, or isolated, from other noises, in an output audio signal, further allowing enhanced applications such as voice communications and voice recognition, including voice recognition for communications, e.g., speech-to-text for short message service (SMS), i.e., texting, or virtual personal assistant (VPA) applications.

Accordingly, there exists a need for, and the instant application is directed to, reliable detection that a user is speaking, generally referred to herein as voice activity detection (VAD).

SUMMARY OF THE INVENTION

Aspects and examples are directed to audio systems and methods that pick-up speech of a user and reduce other acoustic components, such as background noise and other talkers, from one or more microphone signals to enhance the user's speech components over other acoustic components. More particularly, aspects and examples are directed to methods and systems for reliably detecting when the user is speaking, i.e., voice activity detection.

According to one aspect, a method of detecting speech activity of a user is provided and includes receiving a plurality of microphone signals, combining the plurality of microphone signals according to a first combination to produce a primary signal having enhanced response in the direction of the user's mouth, combining the plurality of microphone signals according to a second combination to produce a reference signal having reduced response in the direction of the user's mouth, adding the primary signal and the reference signal to produce a summation signal, subtracting one of the primary signal or the reference signal from the other of the primary signal or the reference signal to produce a difference signal, comparing the summation signal to the difference signal, and providing an output voice signal based upon the comparison.

In various examples, the first combination may be a minimum-variance distortionless response (MVDR) combination. The second combination may be a delay and subtract combination.

According to some examples, comparing the summation signal to the difference signal includes determining at least one of an energy, an amplitude, or an envelope of each of the summation signal and the difference signal and comparing the at least one of an energy, an amplitude, or envelope of the summation signal and the difference signal. Such a comparison may further include comparing at least one of a ratio or a difference to a threshold, or multiplying at least one of the energy, amplitude, or envelopes by a factor and comparing the factored energy, amplitude, or envelope to the other energy, amplitude, or envelope.

In various examples, comparing the summation signal to the difference signal comprises comparing the summation signal to the difference signal in a first frequency band and in a second frequency band, the second frequency band being different from the first frequency band. In certain examples the first frequency band may include frequencies in the range of 200-400 Hz and the second frequency band may include frequencies in the range of 500 Hz-700 Hz.

Some examples may include processing a voice signal with an adaptive filter and altering the adaptive filter based upon the comparison. Altering the adaptive filter may include changing coefficients of the adaptive filter, changing an adaptation rate, changing a step size, freezing the adaptation, or disabling the adaptive filter.

According to another aspect, an audio system is provided that includes a plurality of microphones and a controller coupled to the plurality of microphones. The controller is configured to receive a plurality of microphone signals from the plurality of microphones, combine the plurality of microphone signals according to a first combination to produce a primary signal having enhanced response in the direction of the user's mouth, combine the plurality of microphone signals according to a second combination to produce a reference signal having reduced response in the direction of the user's mouth, add the primary signal and the reference signal to produce a summation signal, subtract one of the primary signal or the reference signal from the other of the primary signal or the reference signal to produce a difference signal, compare the summation signal to the difference signal, and provide an output voice signal based upon the comparison.

In some examples, the first combination may be a minimum-variance distortionless response (MVDR) combination and the second combination may be a delay and subtract combination.

In various examples, comparing the summation signal to the difference signal includes determining at least one of an energy, an amplitude, or an envelope of each of the summation signal and the difference signal and comparing the at least one of an energy, an amplitude, or envelope of the summation signal and the difference signal.

In various examples, comparing the summation signal to the difference signal comprises comparing the summation signal to the difference signal in a first frequency band and in a second frequency band, the second frequency band being different from the first frequency band. For instance, in certain examples, the first frequency band may include frequencies in the range of 200-400 Hz and the second frequency band may include frequencies in the range of 500 Hz-700 Hz.

In some examples, providing the voice signal based upon the comparison may include processing the voice signal with an adaptive filter and altering the adaptive filter based upon the comparison. Altering the adaptive filter may include changing coefficients of the adaptive filter, changing an adaptation rate, changing a step size, freezing the adaptation, or disabling the adaptive filter.

According to yet another aspect, a non-transitory computer readable medium having instructions encoded thereon is provided, the instructions, when executed by a suitable processor (or processors), cause the processor to perform a method that includes receiving a plurality of microphone signals, combining the plurality of microphone signals according to a first combination to produce a primary signal having enhanced response in the direction of the user's mouth, combining the plurality of microphone signals according to a second combination to produce a reference signal having reduced response in the direction of the user's mouth, adding the primary signal and the reference signal to produce a summation signal, subtracting one of the primary signal or the reference signal from the other of the primary signal or the reference signal to produce a difference signal, comparing the summation signal to the difference signal, and providing an output voice signal based upon the comparison.

In various examples, the first combination may be a minimum-variance distortionless response (MVDR) combination. The second combination may be a delay and subtract combination.

According to some examples, comparing the summation signal to the difference signal includes determining at least one of an energy, an amplitude, or an envelope of each of the summation signal and the difference signal and comparing the at least one of an energy, an amplitude, or envelope of the summation signal and the difference signal. Such a comparison may further include comparing at least one of a ratio or a difference to a threshold, or multiplying at least one of the energy, amplitude, or envelopes by a factor and comparing the factored energy, amplitude, or envelope to the other energy, amplitude, or envelope.

In various examples, comparing the summation signal to the difference signal comprises comparing the summation signal to the difference signal in a first frequency band and in a second frequency band, the second frequency band being different from the first frequency band. In certain examples the first frequency band may include frequencies in the range of 200-400 Hz and the second frequency band may include frequencies in the range of 500 Hz-700 Hz.

Some examples may include processing a voice signal with an adaptive filter and altering the adaptive filter based upon the comparison. Altering the adaptive filter may include changing coefficients of the adaptive filter, changing an adaptation rate, changing a step size, freezing the adaptation, or disabling the adaptive filter.

Still other aspects, examples, and advantages of these exemplary aspects and examples are discussed in detail below. Examples disclosed herein may be combined with other examples in any manner consistent with at least one of the principles disclosed herein, and references to "an example," "some examples," "an alternate example," "various examples," "one example" or the like are not necessarily mutually exclusive and are intended to indicate that a particular feature, structure, or characteristic described may be included in at least one example. The appearances of such terms herein are not necessarily all referring to the same example.

BRIEF DESCRIPTION OF THE DRAWINGS

Various aspects of at least one example are discussed below with reference to the accompanying figures, which are not intended to be drawn to scale. The figures are included to provide illustration and a further understanding of the various aspects and examples, and are incorporated in and constitute a part of this specification, but are not intended as a definition of the limits of the invention. In the figures, identical or nearly identical components illustrated in various figures may be represented by a like numeral. For purposes of clarity, not every component may be labeled in every figure. In the figures.

DETAILED DESCRIPTION

Figure 1:
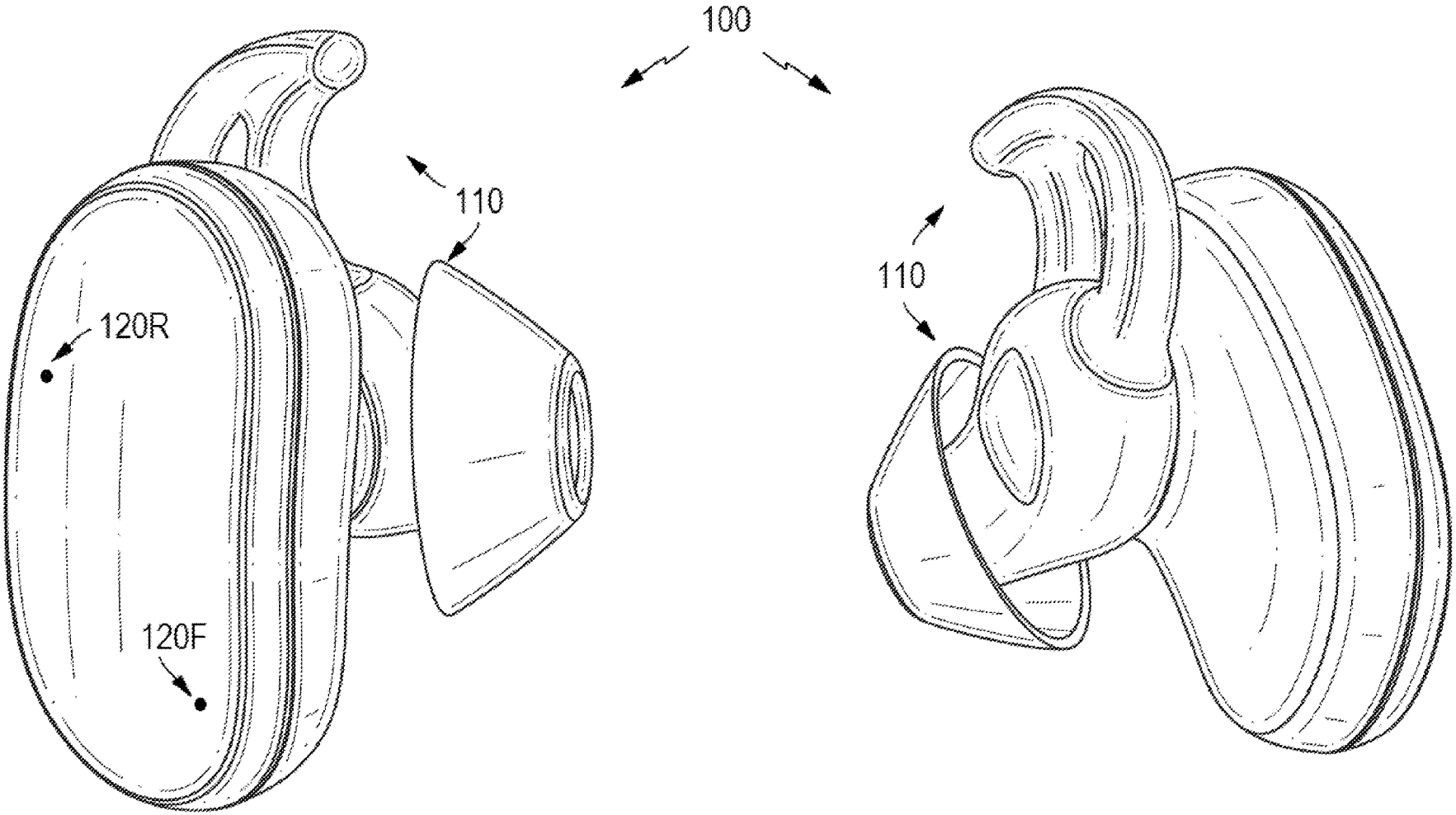
FIG. 1 is a pair of perspective views of an example earphone.

Aspects of the present disclosure are directed to audio systems and methods that support pick-up of a voice signal of the user (e.g., wearer) of a headphone, earphone, or the like, by reliably detecting the voice activity of the user, e.g., detecting when the user is speaking. Conventional voice activity detection (VAD) systems and methods may receive or construct a primary signal that is configured or arranged to include a user speech component and receive of construct a reference signal that is configured or arranged to not include (or have reduced inclusion of) the user speech component. The signal envelope, amplitude, or energy of the primary signal is compared to that of the reference signal, and if the primary signal exceeds a threshold relative to the reference signal it is determined that the user is speaking. Such systems and methods typically output a binary flag, e.g., VAD=0, 1, to indicate whether the user is speaking or not. The flag may be beneficially applied to other parts of the audio system, such as to freeze adaptation of an adaptive filter of a noise cancellation or reduction system and/or an echo canceller. Application of the VAD indication may encompass multiple other actions or effects outside the scope of this disclosure but apparent to those of skill in the art.

Conventional VAD systems and methods in accord with those described above may encounter reduced performance when the audio system is near a boundary condition, e.g., an acoustically reflective environment such as nearby walls and/or the user's arms, hands, etc. being placed near the headphone, earphone, or the like. Essentially, acoustic reflections of the user's voice from the boundary condition may get into the reference signal, thus reducing the differential signal energy between the primary signal (intended to include the user's voice) and the reference signal (intended to not include the user's voice). Aspects and examples described herein accommodate this phenomenon and enhance the reliability of voice activity detection when the user is near or creates a boundary condition, e.g., a relatively nearby acoustically reflective object or surface.

Attaining a user's voice signal with reduced noise and/or echo components may enhance voice-based features or functions available as part of the audio system or other associated equipment, such as communications systems (cellular, radio, aviation), entertainment systems (gaming), speech recognition applications (speech-to-text, virtual personal assistants), and other systems and applications that process audio, especially speech or voice. Examples disclosed herein may be coupled to, or placed in connection with, other systems, through wired or wireless means, or may be independent of other systems or equipment.

Headphones, earphones, headsets, and other various personal audio system form factors (e.g., in-ear transducers, earbuds, neck or shoulder worn devices, and other head worn devices, glasses, etc. with integrated audio) are in accord with various aspects and examples herein.

In general, acoustic reflections from nearby environmental boundaries (e.g., surfaces and objects) may cause significant reduction in conventional VAD performance in one-sided (e.g., left or right) audio systems as compared to binaural audio systems (left and right) due to additional signal characteristics between the left and right sides that may not be available in one-sided systems and methods. Accordingly, aspects and examples disclosed herein may be more suitable to one-sided audio systems and methods. Nonetheless aspects and examples described may be applied to binaural systems and methods as well.

Examples disclosed herein may be combined with other examples in any manner consistent with at least one of the principles disclosed herein, and references to "an example," "some examples," "an alternate example," "various examples," "one example" or the like are not necessarily mutually exclusive and are intended to indicate that a particular feature, structure, or characteristic described may be included in at least one example. The appearances of such terms herein are not necessarily all referring to the same example.

It is to be appreciated that examples of the methods and apparatuses discussed herein are not limited in application to the details of construction and the arrangement of components set forth in the following description or illustrated in the accompanying drawings. The methods and apparatuses are capable of implementation in other examples and of being practiced or of being carried out in various ways. Examples of specific implementations are provided herein for illustrative purposes only and are not intended to be limiting. Also, the phraseology and terminology used herein is for the purpose of description and should not be regarded as limiting. The use herein of "including," "comprising," "having," "containing," "involving," and variations thereof is meant to encompass the items listed thereafter and equivalents thereof as well as additional items. References to "or" may be construed as inclusive so that any terms described using "or" may indicate any of a single, more than one, and all of the described terms. Any references to front and back, right and left, top and bottom, upper and lower, and vertical and horizontal are intended for convenience of description, not to limit the present systems and methods or their components to any one positional or spatial orientation.

FIG. 1 illustrates one example of an earbud 100 that includes an ear tip 110, an acoustic transducer (loudspeaker, internal and therefore not shown) for producing acoustic output from, e.g., an audio signal, and one or more microphones 120. Although the example earbud 100 is shown for a right ear, left ear examples may also be provided, e.g., in a symmetrical or mirror-image, and/or various examples may include a pair of left and right earbuds. In general, the ear tip 110 includes an acoustic channel and a tip with features, e.g., an 'umbrella,' configured to provide a level of acoustic seal near the ear canal of a user, e.g., a wearer, of the earbud 100. The ear tip also includes retention and stabilization features, e.g., two arms that connect at a distal end, to retain the earbud 100 in a user's ear when in use. other examples may include different support structures to maintain one or more earpieces in proximity to a user's ear. For example, open-ear audio devices that may be incorporated into glasses or other head-worn devices and/or structures that may be worn near or about the head, neck, and/or ears.

The earbud 100 is illustrated with two microphones 120, a more frontward microphone 120F and a more rearward microphone 120R (collectively, 120). In other examples, more microphones may be included and may be arranged in varying positions. The microphones 120 are located in varying positions such that they do not receive identical acoustic signals. Varying combinations of the two or more microphone signals may be beneficially compared to detect whether a user is speaking, to provide a voice signal representative of the user's voice, to remove or reduce noise and/or echo components from the voice signal, and various other signal processing and/or communications functions and features.

While microphones are illustrated and labeled with reference numerals, the visual element illustrated in the figures may, in some examples, represent an acoustic port wherein acoustic signals enter to ultimately reach a microphone, which may be internal and not physically visible from the exterior. In examples, one or more of the microphones 120 may be immediately adjacent to the interior of an acoustic port or may be removed from an acoustic port by a distance and may include an acoustic waveguide between an acoustic port and an associated microphone.

Signals from the microphones 120 are combined in varying ways to advantageously steer beams and nulls in a manner that maximizes the user's voice in one instance to provide a primary signal and minimizes the user's voice in another instance to provide a reference signal. The reference signal may therefore be representative of the surrounding environmental noise and may be provided as a reference to an adaptive filter of a noise reduction subsystem. Such a noise reduction system may modify the primary signal to reduce components correlated to the reference signal, e.g., the noise correlated signal, and the noise reduction subsystem provides an output signal that approximates the user's voice signal, with reduced noise content.

In various examples, signals may be advantageously processed in different sub-bands to enhance the effectiveness of the noise reduction or other signal processing. Production of a signal wherein a user's voice components are enhanced while other components are reduced is referred to generally herein as voice pick-up, voice selection, voice isolation, speech enhancement, and the like. As used herein, the terms "voice," "speech," "talk," and variations thereof are used interchangeably and without regard for whether such speech involves use of the vocal folds.

Figure 2:
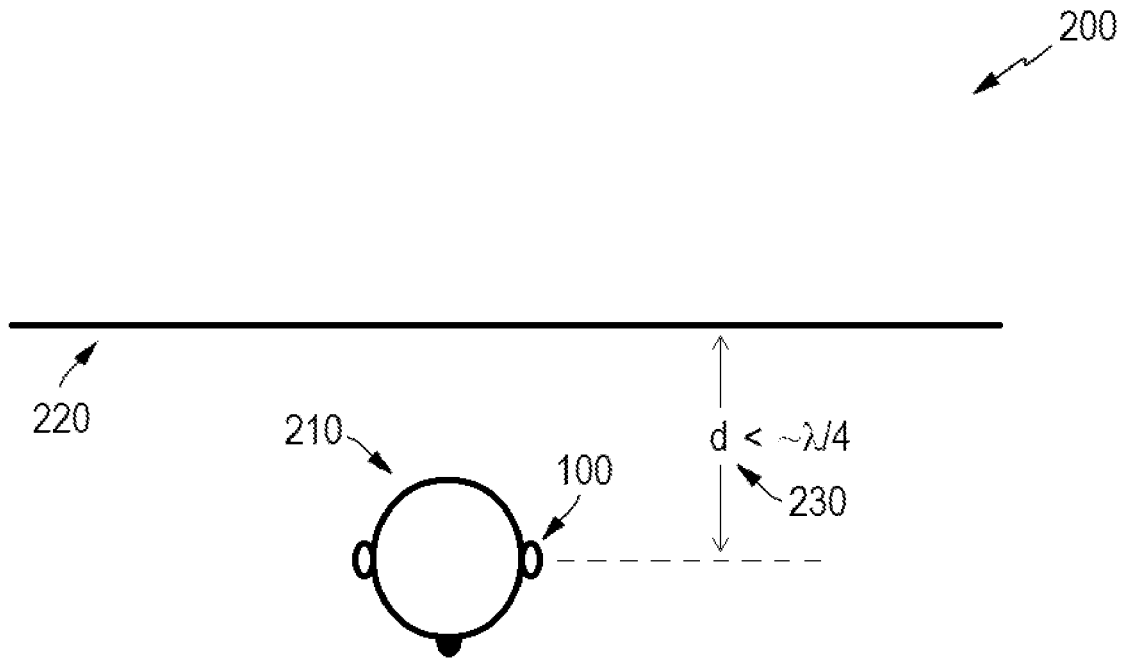
FIG. 2 is a schematic diagram of an environment in which the example earphone of FIG. 1 might be used.

FIG. 2 illustrates an example environment 200 in which a user 210 (illustrated as a top view of the user's head) may be wearing an audio device, such as the earbud 100, near an acoustically reflective surface 220, such as a wall. For certain acoustic frequencies, and in particular frequencies for which the distance, d, (230) of the earbud 100 from the reflective surface 220 is less than a quarter wavelength away, indirect acoustic energy reflecting from the acoustically reflective surface 220 may become substantially in-phase with direct acoustic energy arriving at the microphones 120. Accordingly, various signal processing of one or more microphone signals, or combinations of microphone signals, may exhibit diminished performance when such signal processing depends upon the directionality of various components in the microphone signals. For example, voice activity detectors, noise reduction systems, echo reduction systems, and the like, especially those that depend upon combinations of microphone signals to enhance or reduce acoustic signals coming from certain directions (e.g., beam formers and null formers, or generally, array processing) may exhibit diminished performance, such as when signal content intended to be excluded by such combinations is instead included because it is reflected by the reflective surface 220. In various examples, an acoustically reflective surface such as the reflective surface 220 may be a wall, corner, half-wall, furniture or other objects, headrest, or the user's hands (such as when gesturing, reaching for the earbud 100, or holding hands behind the head).

Figure 3:
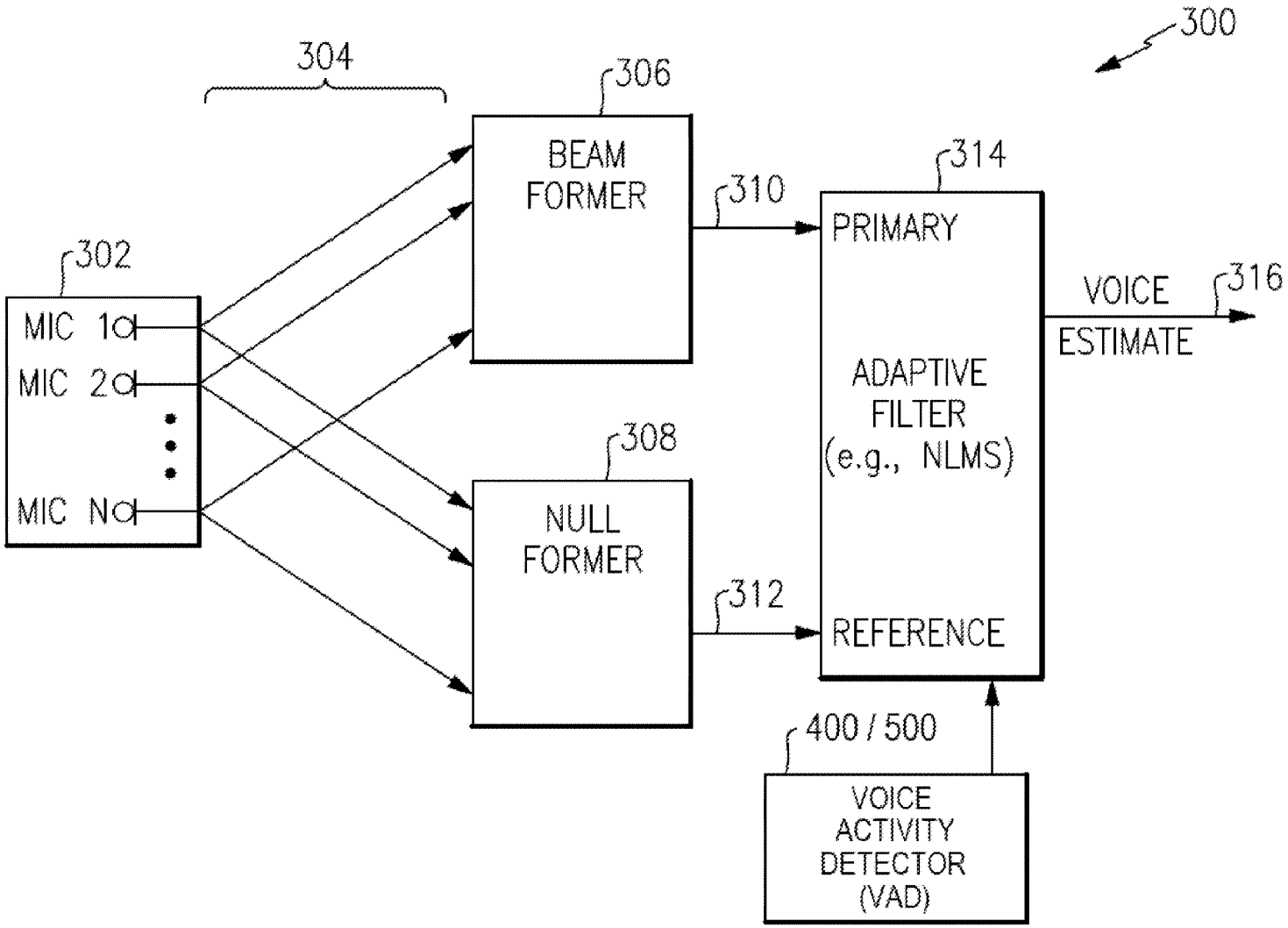
FIG. 3 is a schematic diagram of an example noise reduction system to enhance a user's voice signal among other acoustic signals.

FIG. 3 is a block diagram of an example noise reduction system 300 that processes microphone signals to produce an output signal that includes a user's voice component enhanced with respect to background noise and other talkers. A set of multiple microphones 302 (such as the microphones 120 of FIGS. 1-2) convert acoustic energy into electronic signals 304 and provide the signals 304 to each of two array processors 306, 308. The signals 304 may be in analog form. Alternately, one or more analog-to-digital converters (ADC) (not shown) may first convert the microphone outputs so that the signals 304 may be in digital form. The array processors 306, 308 apply array processing techniques, such as phased array, delay-and-sum techniques, and may utilize minimum variance distortionless response (MVDR) and linear constraint minimum variance (LCMV) techniques, to adapt a responsiveness of the set of microphones 302 to enhance or reject acoustic signals from various directions.

Beam forming enhances acoustic signals from a particular direction, or range of directions, while null forming reduces or rejects acoustic signals from a particular direction or range of directions. The first array processor 306 is a beam former that works to maximize acoustic response of the set of microphones 302 in the direction of the user's mouth (e.g., directed to the front of and lower than the earbud 100, for instance), and provides a primary signal 310. Because of the beam forming array processor 306, the primary signal 310 includes a higher signal energy of the user's voice than any of the individual microphone signals 304 would have. The primary signal 310, which is the output of the first array processor 306, may be considered equivalent to the output of a directional microphone pointed at the user's mouth.

The second array processor 308 steers a null toward the user's mouth and provides a reference signal 312. The reference signal 312 includes minimal, if any, signal energy of the user's voice because of the null directed at the user's mouth. Accordingly, the reference signal 312 is composed substantially of components due to background noise and other acoustic sources that are not the user's voice. For instance, the reference signal 312 is a signal correlated to the acoustic environment apart from the user's voice. The reference signal 312, which is the output of the second array processor 308, may be considered equivalent to the output of a microphone pointed at the surroundings (everywhere but the user's mouth).

The primary signal 310 includes a user's voice component and includes a noise component (e.g., background, other talkers, etc.) while under normal circumstances the reference signal 312 substantially includes only a noise component. If the reference signal 312 were nearly identical to the noise component of the primary signal 310, the noise component of the primary signal 310 could be removed by simply subtracting the reference signal 312 from the primary signal 310. In practice, however, the reference signal 312 is related to and indicative of the noise component of the primary signal 310, but not precisely equal to the noise component of the primary signal 310, as will be understood by one of skill in the art. Accordingly, adaptive filtration may be used to remove at least some of the noise component from the primary signal 310 by using the reference signal 312 as indicative of the noise component.

Numerous adaptive filter methods known in the art are designed to remove components correlated to a reference signal. For example, certain examples include a normalized least mean square (NLMS) adaptive filter. The output of the adaptive filter 314 is a voice estimate signal 316, which represents an approximation of the user's voice signal.

Example adaptive filters 314 may include various types incorporating various adaptive techniques, e.g., NLMS. The operation of an adaptive filter generally includes a digital filter that receives a reference signal correlated to an unwanted component of a primary signal. The digital filter attempts to generate from the reference signal an estimate of the unwanted component in the primary signal. The unwanted component of the primary signal is, by definition, a noise component. The digital filter's estimate of the noise component is a noise estimate. If the digital filter generates a good noise estimate, the noise component may be effectively removed from the primary signal by simply subtracting the noise estimate. On the other hand, if the digital filter is not generating a good estimate of the noise component, such a subtraction may be ineffective or may degrade the primary signal, e.g., increase the noise. Accordingly, an adaptive algorithm operates in parallel to the digital filter and makes adjustments to the digital filter in the form of, e.g., changing weights or filter coefficients. In certain examples, the adaptive algorithm may monitor the primary signal when it is known to have only a noise component, i.e., when the user is not talking, and adapt the digital filter to generate a noise estimate that matches the primary signal, which at that moment includes only a noise component. The adaptive algorithm may know when the user is not talking by various means. In at least one example, the system enforces a pause or a quiet period after triggering speech enhancement. For example, the user may be required to press a button or speak a wake-up command and then pause until the system indicates to the user that it is ready. During the required pause the adaptive algorithm monitors the primary signal, which does not include any user speech, and adapts the filter to the background noise. Thereafter when the user speaks the digital filter generates a good noise estimate, which is subtracted from the primary signal to generate the voice estimate, for example, the voice estimate signal 316.

Figure 4:
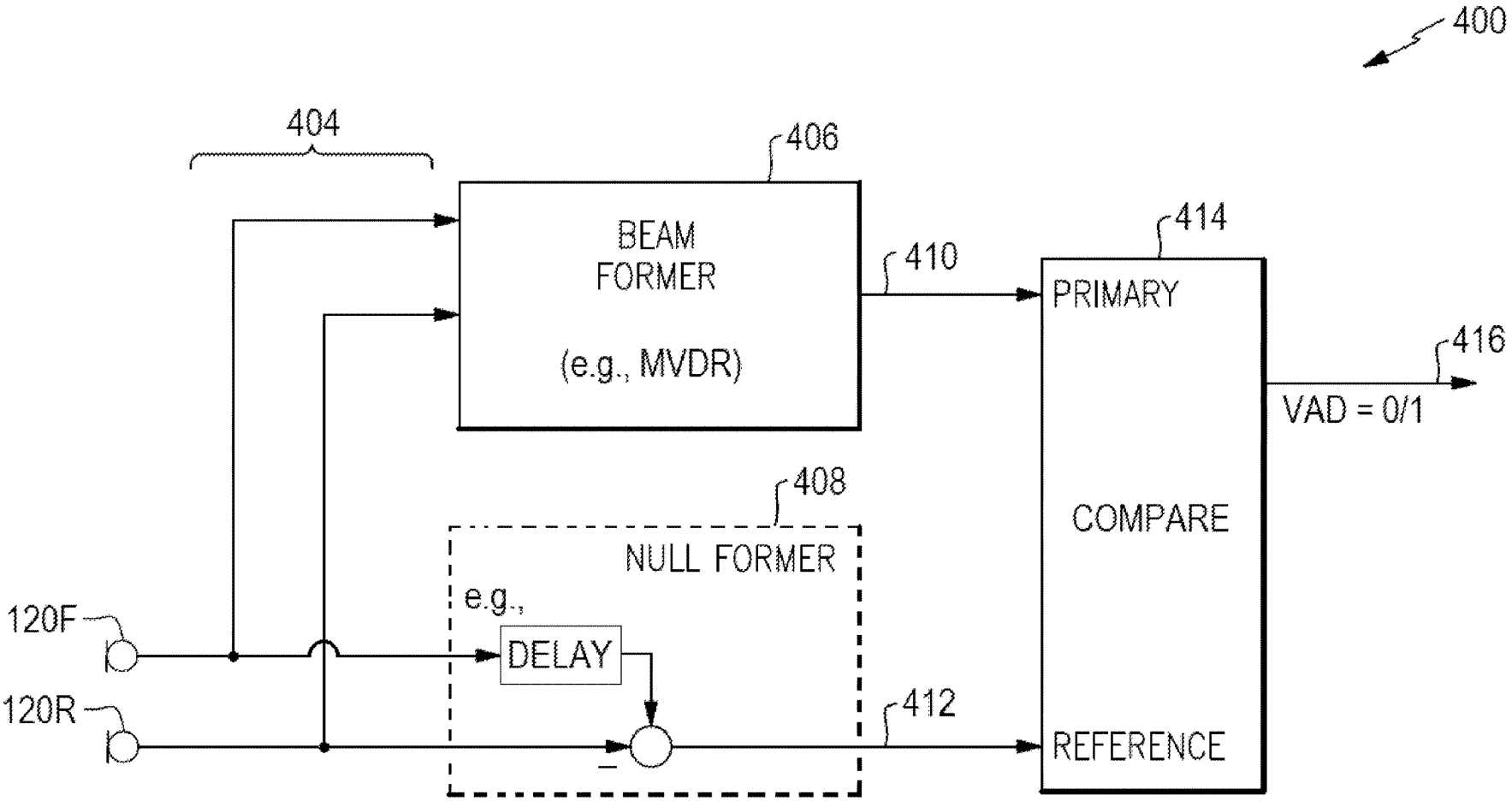
FIG. 4 is a schematic diagram of an example system to detect a user's voice activity.
Figure 5:
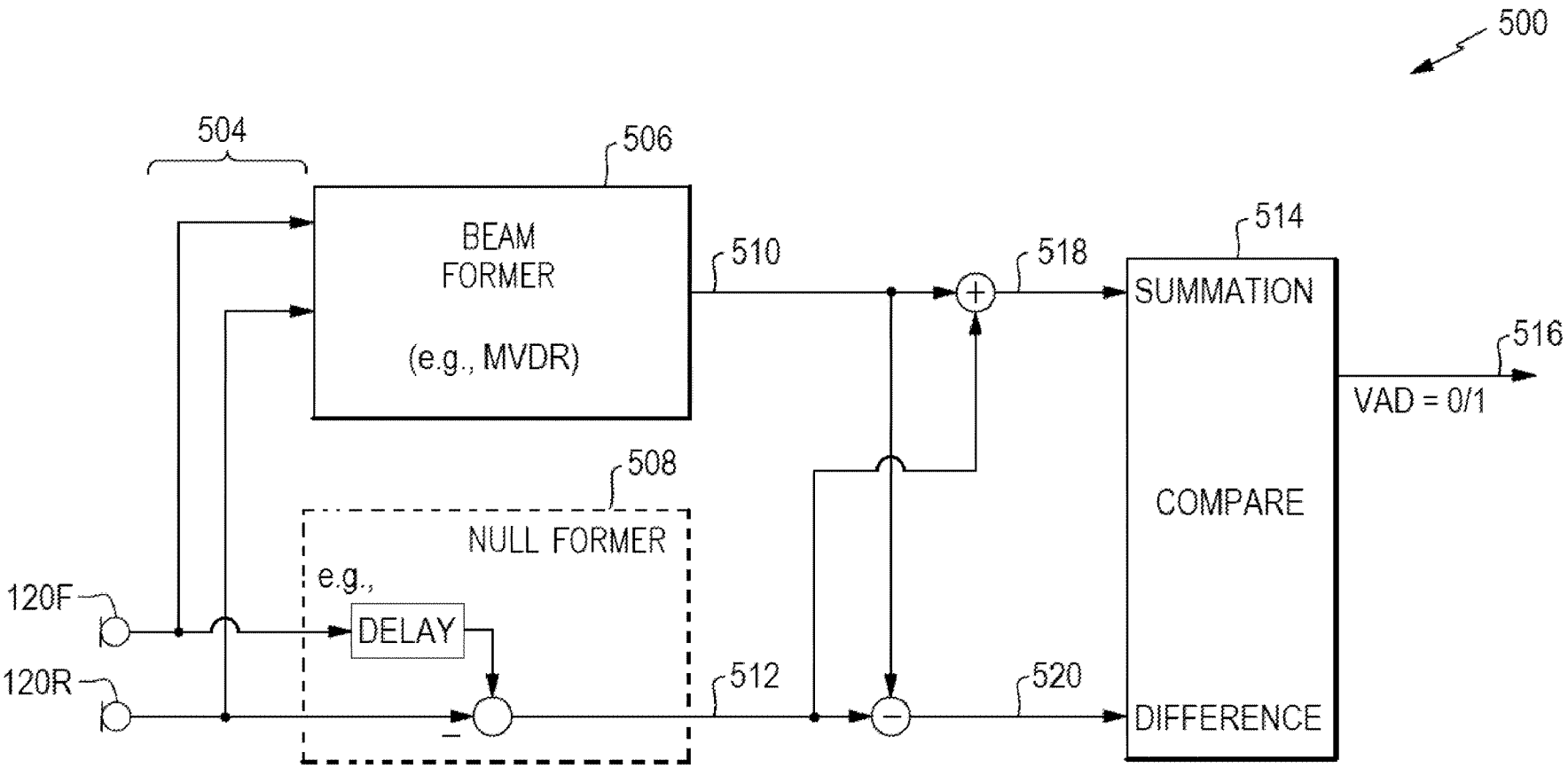
FIG. 5 is a schematic diagram of another example system to detect a user's voice activity.

Additionally, and in accord with examples herein, a voice activity detector 400, 500 (VAD) may operate to detect when the user is or isn't speaking. FIGS. 4 and 5 each illustrate the operation of an example voice activity detection algorithm. In the example of FIG. 4, two microphones 120 are used, though in other examples additional microphones may be used. Similar to the noise reduction system 300 of FIG. 3, the VAD 400 combines the microphone signals 404 according to a first combination 406 to produce a primary signal 410 and according to a second combination 408 to produce a reference signal 412. In some examples, the primary signal 410 may be the same signal as the primary signal 310, but not necessarily. Likewise, in some examples the reference signal 412 may be the same signal as the reference signal 312, but not necessarily.

The first combination 406 may be an array processing that combines the microphone signals 404 to have an enhanced response in the direction of the user's mouth, thereby producing the primary signal 410 with an enhanced voice component when the user is speaking. According to certain examples, the first combination 406 may be a MVDR beam former. The primary signal 410, which is the output of the first combination 406, may be considered equivalent to the output of a directional microphone pointed at the user's mouth.

The second combination 408 may be an array processing that combines the microphone signals 404 to have a reduced response in the direction of the user's mouth, thereby producing the reference signal 412 with a reduced voice component (and thereby an enhanced noise component, representative of the surrounding environment). In some examples, the second combination 408 may be a null former having a null (or low) response in the direction of the user's mouth. The reference signal 412, which is the output of the second combination 408, may be considered equivalent to the output of a microphone pointed at the surroundings (everywhere but the user's mouth).

According to at least one example, the second combination 408 may a delay and subtract combination of the microphone signals 404. With reference to the earbud 100 of FIGS. 1 and 2, the front microphone 120F is closer to a user's mouth than the rear microphone 120R when properly worn by the user. The user's voice therefore reaches the front microphone 120F prior to reaching the rear microphone 120R. Accordingly, delaying the signal from the front microphone 120F by an appropriate amount of time (to time-align the two microphone signals) and subtracting either of the microphone signals from the other may thereby cancel out the user's voice component. Accordingly, in this example, the reference signal 412 has reduced user voice components.

With continued reference to the VAD 400 of FIG. 4, a comparator 414 compares the primary signal 410 to the reference signal 412. When the user is not speaking, the primary signal 410 and the reference signal 412 may have a certain relationship to each other, such as their relative energies may be substantially constant, but if the user starts to speak, the energy in the primary signal 410 may increase significantly (because it includes the user's voice) while the reference signal 412 may not increase (because it rejects the user's voice). In a sense, the reference signal 412 may be indicative of the acoustic environment (e.g., how noisy it is) from which the comparator 414 may "expect" a baseline signal level in the primary signal, and if the primary signal 414 exceeds the baseline level, it is likely because the user is speaking. Accordingly, the comparator 414 may make a determination whether the user is speaking and provide an output 416 that indicates voice activity detected (or not). According to various examples, the output 416 may have two states, e.g., a logical one or zero, to indicate whether the user is speaking or not. Other examples may provide various forms of output 416.

According to various examples, the comparator 414 may compare any one or more of an energy, amplitude, envelope, or other attribute of the signals being compared. Further, the comparator 414 may compare the signals to each other and/or may compare a threshold value to either of the signals and/or to any of a ratio or a difference of the signals, e.g., a ratio or difference of the signals' energies, amplitudes, envelopes, etc. The comparator 414 may include smoothing, time averaging, or low pass filtering of the signals in various examples. The comparator 414 may make comparisons within limited bands or sub-bands of frequencies in various examples.

In some examples, it may be desirable for the comparator 414 to take a ratio of signal energies (or amplitudes, envelopes, etc.) and compare the ratio to a threshold. Instead of strictly calculating a ratio, which may take significant computational resources, some examples may equivalently adjust one of the signal attributes by multiplying it by a factor and then compare the adjusted signal attribute to the comparable attribute of the other signal. For instance, in some examples a VAD=1 (voice detected) determination may be output by the comparator 414 when the primary signal 410 has a signal energy that exceeds the reference signal 412 energy by a certain amount (or vice versa), let's say 20%. In some examples, the comparator 414 may determine the signal energies, calculate the ratio of the signal energies, and compare the ratio to a threshold of 1.2 (e.g., representing 20% higher). In some examples, however, the comparator 414 may equivalently multiply one of the signal energies by 1.2 and compare the result directly to the other signal energy. For instance, the multiplication may be less computationally expensive than calculating a ratio between two signal energies.

The ability to detect voice activity may be a core control in various audio systems, and especially audio systems that include voice pick-up and other processing to provide an outgoing user voice signal. For example, audio systems may include one or more subsystems that perform adaptive processing when the user is not speaking but need to freeze adaptation when the user starts to speak (for example, the noise reduction system 300 of FIG. 3). Various subsystems may alter their operation in different ways depending upon whether the user is speaking and/or may terminate their operation when the user is speaking. For instance, in some examples an outgoing user voice signal may be suspended when the user isn't speaking, such as operation in a half-duplex mode to save energy and/or bandwidth. The VAD lets the system know to start transmitting again. For these reasons and others an effective voice activity detection is essential. In particular, if the VAD fails, the user's voice component may get treated like noise and adaptive processing may detrimentally operate to remove it.

The example VAD 400 of FIG. 4 relies on the reference signal 412 having a reduced component of the user's voice. However, in situations when the user is near an acoustically reflective surface, such as a wall or other objects, or the user's hands near the microphones (hands behind the head, reaching for the earbud 100, etc.), the user's voice may reflect off the nearby surface and provide a second (non-direct) source of the user's voice at the microphones 120. Accordingly, the second combination 408 may not be as effective at rejecting user voice components in such situations. Instead, the reference signal 412 may include portions of the user's voice from the reflections off the nearby surface. In such situations the VAD 400 may fail to detect speech at least in part because both of the reference signal 412 and the primary signal 410 increase when the user starts speaking, which may not cause enough of a difference between the signals for the comparator 414 to determine the user is speaking.

For example, if the user gets close to a wall, there may be a significant reflection of the user's speech which is not rejected by the second combination 408. Further, such speech energy in the reference signal 412 may also be in the reference signal 312 of, e.g., a noise reduction system (see FIG. 3), which may result in the adaptive processing of the noise reduction system trying to remove the speech.

With reference to FIG. 5, a further example VAD 500 is illustrated. The VAD 500 is similar to the VAD 400 but includes additional processing to account for correlated energy due to nearby reflective surface(s) between a first combination 506 of microphone signals 504 (e.g., an MVDR beamformer) and a second combination 508 (e.g., a Delay and Subtract nullformer). When the user is near an acoustically reflective surface, indirect (reflected) speech may be substantially in-phase with the user's direct speech (e.g., at low frequencies for which the surface is about ¼ wavelength or less away from the user). Accordingly, the second combination 508 may not reject such reflected user voice energy because it does not come from the direction of the user's mouth and therefore does not arrive at the proper time difference for the delay-and-subtract to cancel it. The VAD 500 accounts for this by performing an addition and subtraction between the primary signal 510 and the reference signal 512 and comparing the resulting summation and difference signals rather than the primary and reference signals.

As described above, the first combination 506 includes the user's voice in the primary signal 510. When the user is close to a wall or other reflection source, lower frequencies of speech will reflect into the microphone signals 504 that are not rejected (or reduced) by the second combination 508 and thus the reference signal 512 also has components of the user's voice. For various frequency sub-bands, such as those for which the reflection source is a ¼ wavelength away or less, the voice components in the reference signal 512 may be substantially in-phase with the voice components in the primary signal 510. As such, a summation of the primary signal 510 and the reference signal 512 (to produce a summation signal 518) reinforces the in phase low frequency bin energy while a subtraction of one of the primary signal 510 and the reference signal 512 from the other (to produce a difference signal 520) cancels or at least significantly reduces the in phase low frequency bin energy. Accordingly, the summation signal 518 will be much greater than the difference signal 520 in the appropriate low frequency portion of the signal spectrum.

In various examples, the summation and difference may be a complex summation and a complex subtraction, respectively, conducted in the frequency domain, e.g., on phase and magnitude information. In other examples, the summation and subtraction may be conducted in the time domain.

According to various examples, a summation and difference may be calculated for a plurality of low frequency bins (and various combinations of said bins) and the relative level of energy may be compared across one or more of the frequency bins. In some examples, the VAD 500 determines the energy of each of the summation signal 518 and the difference signal 520, within the relevant frequency bin(s), and may apply a low pass filter to smooth energy envelopes. The relative level of the frequency bin(s) is then compared to a threshold. If the threshold is exceeded there is likely a boundary interfering with the VAD beamformers. As such the VAD 500 may provide an output signal 516 as a logical TRUE which may be interpreted as an indication that the user is speaking in the presence of boundary interference (a nearby reflective surface).

Figure 6:
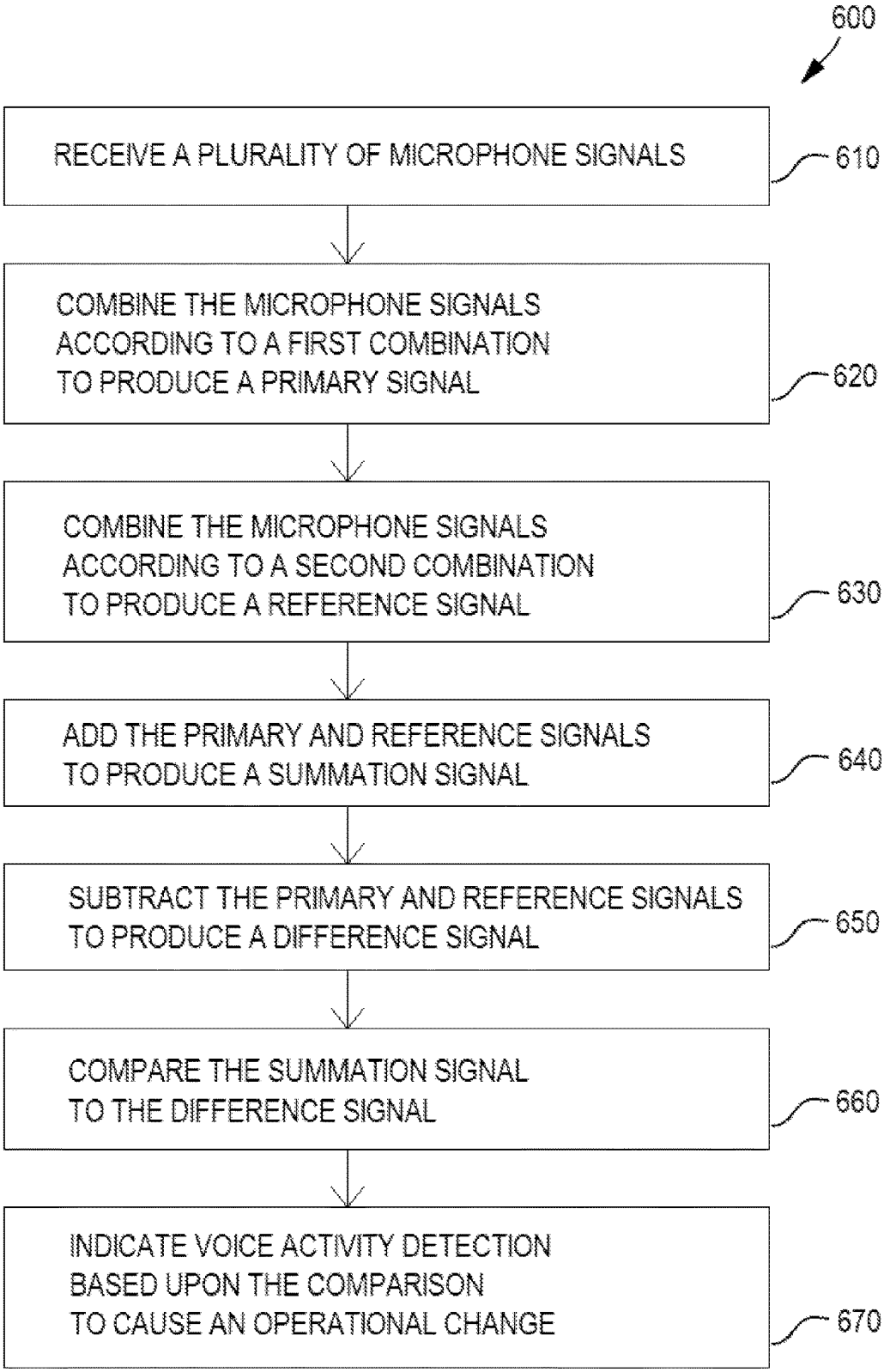
FIG. 6 is a flow diagram of an example voice activity detection method.

In various examples, several frequency bins may be analyzed together and/or separately as the reflection path length is variable resulting in some in and out of phase reflections depending upon distance. For example, if the user puts hands behind his or her head they are much closer to the mic array than a wall might be, such that a higher frequency bin may be in phase. A user's hand(s) may reflect less low frequency energy than a wall, but may reflect more high frequency energy due to generally closer proximity. Accordingly, and in some examples, a nearby wall may be detected by significant in-phase content between the primary signal and the reference signal for frequencies in the range of 200 to 400 Hz, while the user's hand(s) being nearby may be detected by significant in-phase content between the primary signal and the reference signal for frequencies in the range of 500 to 700 Hz FIG. 6 illustrates a method 600 of detecting user voice activity when near an acoustically reflective surface, such as may be implemented by the VAD 500 of FIG. 5. The method 600 receives a plurality of microphone signals (step 610) and combines the microphone signals according to a first combination (step 620) to provide a primary signal and according to a second combination (step 630) to provide a reference signal. The first combination is configured to provide the primary signal with an enhanced component representative of the user's voice while the second combination is configured to provide the reference signal with a reduced component representative of the user's voice. In some examples, the first combination may be configured to provide the primary signal with reduced non-voice components, such as the surrounding environmental noise, while the second combination is configured to provide the reference signal with enhanced non-voice components, such as a noise reference signal (representative of the surrounding environmental noise).

When the microphone signals include reflective acoustic energy from a nearby surface such as a wall or the user's hands (e.g., being near the microphones), there may be substantial in-phase user voice content in the reference signal. Such user voice content in the reference signal may cause conventional voice activity detectors to erroneously conclude that the user isn't speaking, which may cause other subsystems to perform poorly. For example, conventional noise (or echo) reduction subsystems having adaptive filter processing (e.g., see the system 300 of FIG. 3) may freeze adaptation when the user is speaking and a failure to detect the user speaking may cause such subsystems to begin adapting to user voice content when they shouldn't, e.g., such systems typically adapt filters to noise (or echo) content. Even in cases where a conventional voice activity detector accurately detects the voice activity, user voice content in the reference signal may cause poor performance in such other subsystems if the other subsystems use the reference signal as a noise reference signal. Accordingly, it is important to detect when the reference signal (erroneously) includes voice content, e.g., due to a nearby reflective surface.

As stated above, voice content in the reference signal caused by a nearby reflective surface may be in-phase with the voice content in the primary signal for certain frequency bins based upon distance to the reflective surface. The closer the reflective surface, the stronger the reflection (e.g., magnitude) and the higher frequency range in which the reflections will be in-phase.

With continued reference to FIG. 6, to detect in-phase user voice content in the reference signal the method 600 adds the primary signal and the reference signal (step 640) to provide a summation signal and subtracts (calculates a difference between) the primary signal and the reference signal (step 650) to provide a difference signal. If there is significant user voice content in the reference signal in-phase with the primary signal, these in-phase components add (are reinforced) in the summation signal and subtract (are cancelled or reduced) in the difference signal. Accordingly, the method 600 compares (step 660) the summation signal and the difference signal, potentially across various frequency ranges or frequency bins. A sufficient difference (in energy, magnitude, etc.) between the summation signal and the difference signal at certain frequencies, ranges, or bins means that the primary signal and the reference signal contain in-phase components, which based upon the frequencies, ranges, or bins is further indicative that a reflective surface is nearby causing the reference signal to include user voice components. Accordingly, and as discussed above, conventional voice activity detectors may be unreliable in such a scenario and therefore the method 600 indicates that voice activity is detected (step 670), e.g., VAD=1.

As also discussed above, other subsystems may alter their operation based upon the indication of voice activity, such as by freezing adaptive filters, e.g., of noise reduction, echo reduction, and/or other subsystems. In some examples, a noise reduction, echo reduction, or other subsystem may cease operation when the method 600 (or the system 500) indicates voice activity. In various examples, a primary signal (such as any of primary signals 310, 410, 510 of FIG. 3, 4, or 5, respectively) may be provided as an estimated voice signal to be provided as an output voice signal (with or without additional processing) when the method 600 (or the system 500) indicates voice activity. Stated in the alternative, a lack of indicating voice activity (or an indication of no voice activity), e.g., VAD=0, may cause other subsystems to cease processing or providing an output voice signal. In general, therefore, various examples of audio systems and methods in accord with those described herein may include various subsystems whose operation may depend upon a binary indication of voice activity or not, e.g., VAD=0/1, such as by adapting, altering, freezing, ceasing, or starting various processing based upon the output indication of the voice activity detection method 600 or system 500.

As discussed above, the example systems 100, 300, 400, 500 and their associated subsystems, may operate in a digital domain and may include analog-to-digital converters (not shown). Additionally, components and processes included in the example systems may achieve better performance when operating upon narrow-band signals instead of wideband signals. Accordingly, certain examples may include sub-band filtering to allow processing of one or more sub-bands. For example, beam forming, null forming, adaptive filtering, signal combining (addition, subtraction), signal comparisons, voice activity detection, spectral enhancement, and the like may exhibit enhanced functionality when operating upon individual sub-bands. In some examples, sub-bands may be synthesized together after operation of the example systems to produce an output signal. In certain examples, the microphone signals 304, 404, 504 may be filtered to remove content outside the typical spectrum of human speech. Alternately, the example subsystems may be employed to operate only on sub-bands within a spectrum associated with human speech and ignore sub-bands outside that spectrum. Additionally, while the example systems are discussed with reference to only a single set of microphones 120, 302, in certain examples there may be additional sets of microphones, for example a set on the left side and another set on the right side, to which further aspects and examples of the example systems may be applied, and combined.

One or more of the above described systems and methods, in various examples and combinations, may be used to capture the voice of a user and isolate or enhance the user's voice relative to background noise, echoes, and other talkers. Any of the systems and methods described, and variations thereof, may be implemented with varying levels of reliability based on, e.g., microphone quality, microphone placement, acoustic ports, form factor/frame design, threshold values, selection of adaptive, spectral, and other algorithms, weighting factors, window sizes, etc., as well as other criteria that may accommodate varying applications and operational parameters.

Many, if not all, of the functions, methods, and/or components of the systems and methods disclosed herein according to various aspects and examples may be implemented or carried out in a digital signal processor (DSP) and/or other circuitry, analog or digital, suitable for performing signal processing and other functions in accord with the aspects and examples disclosed herein. Additionally or alternatively, a microprocessor, a logic controller, logic circuits, field programmable gate array(s) (FPGA), application-specific integrated circuit(s) (ASIC), general computing processor(s), micro-controller(s), and the like, or any combination of these, may be suitable, and may include analog or digital circuit components and/or other components with respect to any particular implementation. Functions and components disclosed herein may operate in the digital domain, the analog domain, or a combination of the two, and certain examples include analog-to-digital converter(s) (ADC) and/or digital-to-analog converter(s) (DAC) where appropriate, despite the lack of illustration of ADC's or DAC's in the various figures. Any suitable hardware and/or software, including firmware and the like, may be configured to carry out or implement components of the aspects and examples disclosed herein, and various implementations of aspects and examples may include components and/or functionality in addition to those disclosed. Various implementations may include stored instructions for a digital signal processor and/or other circuitry to enable the circuitry, at least in part, to perform the functions described herein.

Having described above several aspects of at least one example, it is to be appreciated various alterations, modifications, and improvements will readily occur to those skilled in the art. Such alterations, modifications, and improvements are intended to be part of this disclosure and are intended to be within the scope of the invention. Accordingly, the foregoing description and drawings are by way of example only, and the scope of the invention should be determined from proper construction of the appended claims, and their equivalents.

What is claimed is:

1. A method of detecting speech activity of a user, the method comprising:

receiving a plurality of microphone signals;

combining the plurality of microphone signals according to a first combination to produce a primary signal having enhanced response in the direction of the user's mouth;

combining the plurality of microphone signals according to a second combination to produce a reference signal having reduced response in the direction of the user's mouth;

combining the primary signal and the reference signal in a manner to enhance a voice portion present in both of the primary signal and the reference signal to produce a voice-enhanced signal;

combining the primary signal and the reference signal in a manner to reduce a voice portion present in both of the primary signal and the reference signal to produce a voice-reduced signal;

comparing the voice-enhanced signal to the voice-reduced signal; and providing an indication that the user is speaking based upon the comparison.

2. The method of claim 1 wherein the first combination is a minimum-variance distortionless response (MVDR) combination.

3. The method of claim 1 wherein the second combination is a delay and subtract combination.

4. The method of claim 1 wherein comparing the voice-enhanced signal to the voice-reduced signal includes determining at least one of an energy, an amplitude, or an envelope of the voice-enhanced signal and the voice-reduced signal and comparing the at least one of an energy, an amplitude, or envelope of the voice-enhanced signal and the voice-reduced signal.

5. The method of claim 4 wherein comparing the at least one of an energy, an amplitude, or envelope of the voice-enhanced signal and the voice-reduced signal includes comparing at least one of a ratio or a difference to a threshold or multiplying at least one of the energy, amplitude, or envelopes by a factor and comparing the factored energy, amplitude, or envelope to the other energy, amplitude, or envelope.

6. The method of claim 1 wherein comparing the voice-enhanced signal to the voice-reduced signal comprises comparing the voice-enhanced signal to the voice-reduced signal in a first frequency band and in a second frequency band, the second frequency band being different from the first frequency band.

7. The method of claim 6 wherein the first frequency band includes frequencies in the range of 200-400 Hz and the second frequency band includes frequencies in the range of 500 Hz-700 Hz.

8. The method of claim 1 further comprising processing a voice signal with an adaptive filter and altering the adaptive filter based upon the comparison.

9. An audio system comprising:

a plurality of microphones; and a controller coupled to the plurality of microphones and configured to:

receive a plurality of microphone signals from the plurality of microphones, combine the plurality of microphone signals according to a first combination to produce a primary signal having enhanced response in the direction of the user's mouth, combine the plurality of microphone signals according to a second combination to produce a reference signal having reduced response in the direction of the user's mouth, combine the primary signal and the reference signal in a manner to enhance a voice portion present in both of the primary signal and the reference signal to produce a voice-enhanced signal, combine the primary signal and the reference signal in a manner to reduce a voice portion present in both of the primary signal and the reference signal to produce a voice-reduced signal, compare the voice-enhanced signal to the voice-reduced signal, and provide an output voice signal based upon the comparison.

10. The audio system of claim 9 wherein the first combination is a minimum-variance distortionless response (MVDR) combination and the second combination is a delay and subtract combination.

11. The audio system of claim 9 wherein comparing the voice-enhanced signal to the voice-reduced signal includes determining at least one of an energy, an amplitude, or an envelope of the voice-enhanced signal and the voice-reduced signal and comparing the at least one of an energy, an amplitude, or envelope of the voice-enhanced signal and the voice-reduced signal.

12. The audio system of claim 9 wherein comparing the voice-enhanced signal to the voice-reduced signal comprises comparing the voice-enhanced signal to the voice-reduced signal in a first frequency band and in a second frequency band, the second frequency band being different from the first frequency band.

13. The audio system of claim 12 wherein the first frequency band includes frequencies in the range of 200-400 Hz and the second frequency band includes frequencies in the range of 500 Hz-700 Hz.

14. The audio system of claim 9 wherein providing the voice signal based upon the comparison comprises processing the voice signal with an adaptive filter and altering the adaptive filter based upon the comparison.

15. A non-transitory computer readable medium having instructions encoded thereon that, when executed by a processor, cause the processor to perform a method comprising:

receiving a plurality of microphone signals;

combining the plurality of microphone signals according to a first combination to produce a primary signal having enhanced response in the direction of the user's mouth;

combining the plurality of microphone signals according to a second combination to produce a reference signal having reduced response in the direction of the user's mouth;

combining the primary signal and the reference signal in a manner to enhance a voice portion present in both of the primary signal and the reference signal to produce a voice-enhanced signal;

combining the primary signal and the reference signal in a manner to reduce a voice portion present in both of the primary signal and the reference signal to produce a voice-reduced signal;

comparing the voice-enhanced signal to the voice-reduced signal; and providing an output voice signal based upon the comparison.

16. The non-transitory computer readable medium of claim 15 wherein the first combination is a minimum-variance distortionless response (MVDR) combination and the second combination is a delay and subtract combination.

17. The non-transitory computer readable medium of claim 15 wherein comparing the voice-enhanced signal to the voice-reduced signal includes determining at least one of an energy, an amplitude, or an envelope of the voice-enhanced signal and the voice-reduced signal and comparing the at least one of an energy, an amplitude, or envelope of the voice-enhanced signal and the voice-reduced signal.

18. The non-transitory computer readable medium of claim 15 wherein comparing the voice-enhanced signal to the voice-reduced signal comprises comparing the voice-enhanced signal to the voice-reduced signal in a first frequency band and in a second frequency band, the second frequency band being different from the first frequency band.

19. The non-transitory computer readable medium of claim 18 wherein the first frequency band includes frequencies in the range of 200-400 Hz and the second frequency band includes frequencies in the range of 500 Hz-700 Hz.

20. The non-transitory computer readable medium of claim 15 wherein providing the voice signal based upon the comparison comprises processing a voice signal with an adaptive filter and altering the adaptive filter based upon the comparison.

* * * * *